US005499462A

United States Patent [19]

Forsdahl et al.

[11] Patent Number: 5,499,462

[45] Date of Patent: Mar. 19, 1996

[54] METHOD AND DEVICE TO SCATTER A PREHEATED MATERIAL ON A SURFACE

[76] Inventors: Sixten Forsdahl, Strandvägen 23, Skoghall, Sweden, S-663 00; Håkan Törner, Botkyrokovägen 3, Stockholm Wårby, Sweden, S-143 00

[21] Appl. No.: 256,472

[22] PCT Filed: Jan. 15, 1993

[86] PCT No.: PCT/SE93/00017

§ 371 Date: Jul. 11, 1994

§ 102(e) Date: Jul. 11, 1994

[87] PCT Pub. No.: WO93/14270

PCT Pub. Date: Jul. 22, 1993

[30] Foreign Application Priority Data

Jan. 15, 1992 [SE] Sweden ..... 9200108

[51] Int. Cl.[6] ..... E01C 19/20

[52] U.S. Cl. ..... 37/227; 37/197; 37/228; 239/130; 239/135; 239/687

[58] Field of Search ..... 37/197, 227, 228; 239/130, 131, 135, 672, 687

[56] References Cited

U.S. PATENT DOCUMENTS

| | | | |
|---|---|---|---|
| 3,844,669 | 10/1974 | Eigenmann | 404/94 |
| 3,853,455 | 12/1974 | Riordan et al. | 431/80 |
| 4,409,957 | 10/1983 | Muhammad | 37/227 X |
| 4,575,010 | 3/1986 | Zimmerman | 239/130 X |
| 4,978,068 | 12/1990 | Eldridge | 37/228 X |

FOREIGN PATENT DOCUMENTS

| | | |
|---|---|---|
| 3002328 | 7/1981 | Germany . |
| 3011076 | 9/1981 | Germany . |
| 3045044 | 10/1982 | Germany . |
| 3423354 | 6/1986 | Germany . |
| 462623 | 10/1982 | Sweden . |

*Primary Examiner*—Kenneth J. Dorner
*Assistant Examiner*—Andrea Chop
*Attorney, Agent, or Firm*—Roylance, Abrams, Berdo & Goodman

[57] ABSTRACT

A method and device scatter preheated sand, urea, road salt, etc. from a spreading vehicle onto runways and roads to counteract slipperiness caused by snow, ice, sleet, mud and the like. Preheating of the material is by an electronically controlled LP-gas driven burner in close association with feeding of the material from the spreading vehicle to the surface which is to be treated. Flames from the burner have direct contact with the material being preheated. The process can be remotely controlled from the driver cabin of the spreading vehicle. The heating system can be conveniently mounted to an existing spreading vehicle.

13 Claims, 1 Drawing Sheet

METHOD AND DEVICE TO SCATTER A PREHEATED MATERIAL ON A SURFACE

BACKGROUND OF THE INVENTION

There are many situations where it is desirable to counteract slipperiness caused by ice, snow, mud, sleet and the like. This can be done, for example, by salting or sanding.

Not least, this applies to airplane runways. Here, urea is used in order to "melt" the icecover and sand with a particular grain size to provide good friction, because airplanes can not tolerate road salt or sand of the wrong grain size. The sand or urea is spread with a special spreading vehicle. The effectiveness of sanding can be considerably increased if the sand is preheated, because the sand then melts solidly to the icecover on the runway and forms a sandpaper-like surface which provides very good friction against airplane wheels during landing and take off.

Sand preheating creates the need for methods and devices to heat the sand. In a currently used system, the sand is stored, continuously heated, in a large silo from which the sand is conveyed to the spreading vehicle and placed in the spreader hopper. The heated sand is conveyed within the spreading vehicle and spread out as desired.

The above described technique suffers from serious disadvantages. In the first place, it requires large investments for the above mentioned sand silo. Secondly, because the entire mass of sand is kept continuously heated, the sand silo represents a waste of energy which also leads to high costs. Thirdly, the technique is not particularly effective because the sand continuously loses heat from the moment it is loaded onto the spreading vehicle. Our measurements show that, in fact, the sand has only a fraction of its warmth left when it reaches the spot where it is to be scattered.

SUMMARY OF THE INVENTION

The object of the present invention is to provide a vehicle-borne method and apparatus to scatter a preheated material onto a surface, especially a preheated, granular anti-slip material onto runways and roads, in which the above described drawbacks are avoided and which gives a high safety level and good control and adjustment. An additional object of the invention is to provide a heating device of the above type which admits of simple installation to existing vehicles. A still further object of the invention is to provide a method and apparatus of the above type which is amenable to low costs, as regards material, installation and fuel consumption.

The foregoing objects are attained in a process for scattering granular material at a raised temperature from a vehicle over a roadway, comprising the steps of feeding the granular material from a supply container in the vehicle by a feed means to an upper, upstream portion of a substantially vertically deposit shaft, conveying the granular material downwardly through the shaft to a scattering means at a lower, downstream portion of the shaft, and heating the granular material during passage thereof downwardly through the shaft by combustion gases flowing under pressure through the shaft from the upstream portion of the shaft to separate and uniformly heat individual particles of the granular material. In this manner, the combustion gases assist transporting the particles through the shaft.

The foregoing objects are also attained by an apparatus for scattering granular material at a raised temperature from a vehicle over a roadway. The apparatus comprises a supply container for holding granular material, and a substantially vertical shaft having an upper, upstream portion, a lower, downstream portion and a central axis. Feed means extends between the supply container and the shaft for conveying granular material from the supply container to the upstream portion of the shaft. Scattering means is located adjacent the downstream portion of the shaft for dispersing the granular materials. Heating means heats the granular material in the shaft. The heating means includes a burner having a nozzle means disposed above and directed towards the upstream portion of the shaft. The nozzle means is oriented substantially coaxially with the central axis of the shaft for flowing combustion gases under pressure through the shaft.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
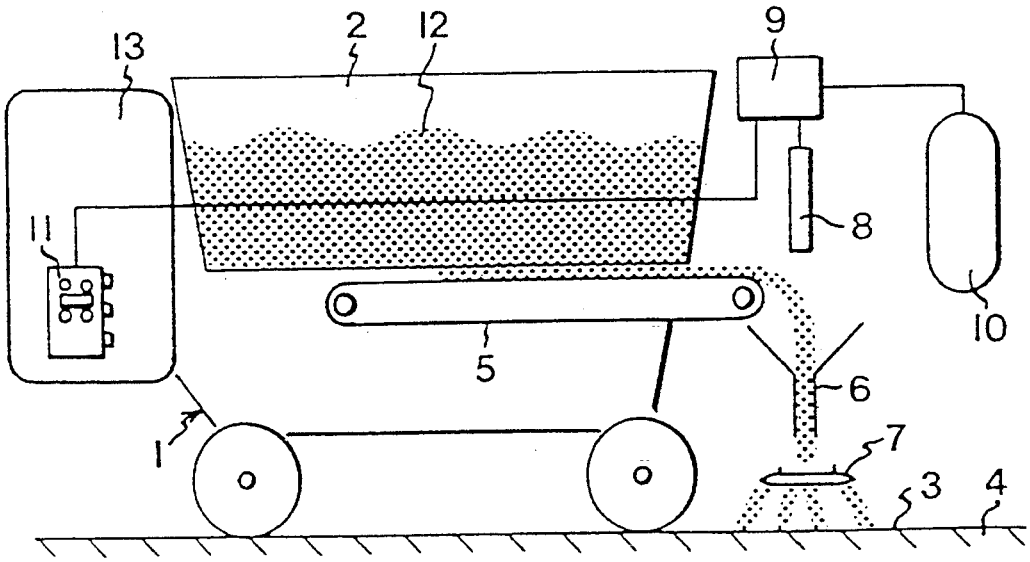
FIG. 1 is a graphical side elevational view of an apparatus for scattering granular material at a raised temperature according to a first embodiment of the present invention.
Figure 2:
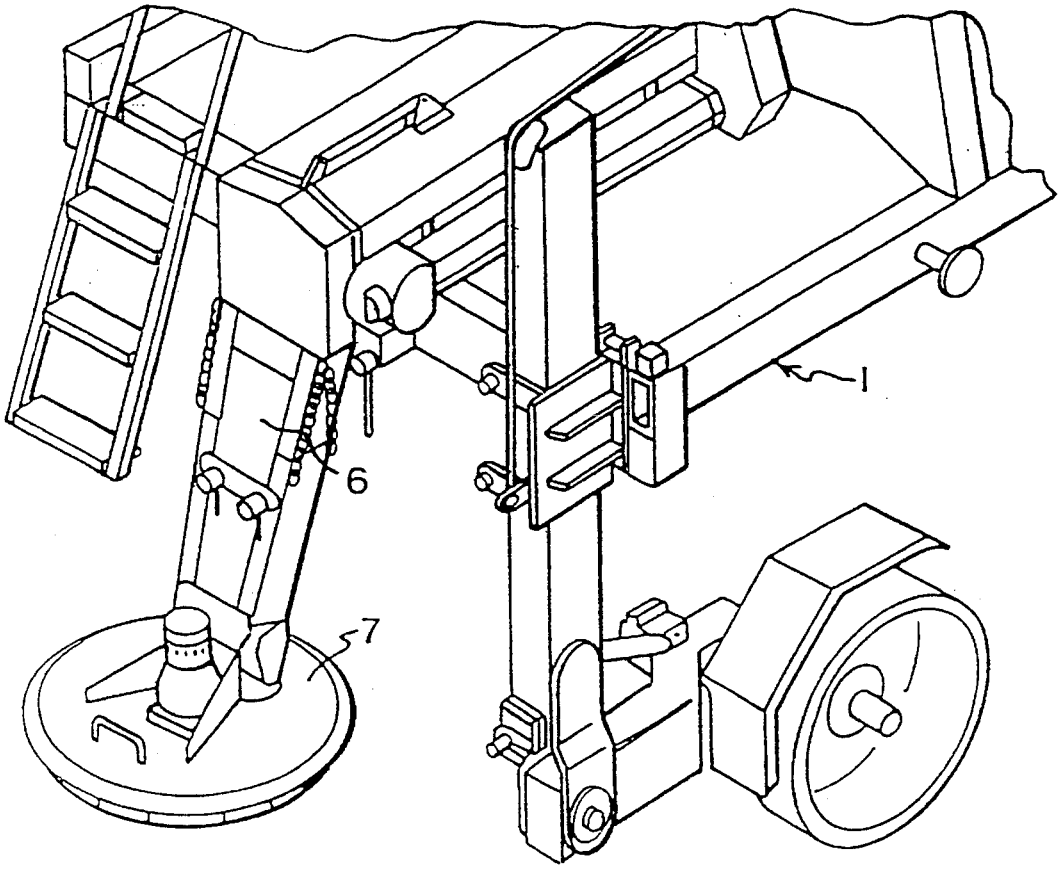
FIG. 2 is a partial, enlarged perspective view of the apparatus of FIG. 1.

FIG. 1 shows a sand spreading vehicle 1 with a store 2 of sand 12 which is fed via a conveyor belt 5 and a sand shaft 6 to a scattering plate 7 which is a rotating disc which centrifugally slings the sand out. The sand then falls onto the surface 4 coated with snow, ice or the like 3 which is to be sanded. The sanding and the sand spreading vehicle are controlled from a driver cabin 13. FIG. 2 shows how the sand shaft 6, in the form of an elongate, narrow tube of rectangular cross section and the scattering plate 7 are centrally mounted at the rear of the spreading vehicle 1.

The sand spreading vehicle is not described further here as vehicles of this type are well known. Additionally, there are a number of different variants of such vehicles in existence. Thus the sand, for example, can be transported with a screw instead of the conveyer belt 5. Furthermore, the sand shaft 6 can have different forms. Still further, the sand spreading vehicle 1 can have more than one scattering plate 7 and more than one sand shaft 6.

A plurality of gas burners 8, which heat the sand prior to it falling through the sand shaft 6, are mounted adjacent the outlet for the sand 12, above the sand shaft 6. The elongate, narrow tube-like form of the sand shaft 6 and the consequent confinement of the sand stream to a relatively limited area provide maximal utilization of the capacity of the burners 8. The burners 8 are directed downwardly into the sand shaft 6 such that the flames from the burners 8 are mixed with the flowing sand. As the sand 12 falls through the sand shaft 6, the sand grains are separated with respect to their distance from each other. The blast effect obtained from the stream of combustion gases from the burners 8 further facilitates this separation process and provides direct contact between the flames and the individual sand grains which gives optimal heat transfer. The flames of the burners 8 follow the sand shaft 6 right down to the scattering plate 7 which provides the sand grains with a maximally long residence time in the hot flame. Additionally, agglomerates of sand grains are split up when they are heated in this fashion. The hot sand grains, charged with heat energy, are immediately scattered by the scattering plate 7 down onto the ground. In this way, the holding time of the sand grains, between heating and contact with the ground is minimized. The heat energy stored in the sand grains is sufficient to solidly melt them onto the surface of, for example, the ice layer on an airplane runway.

Advantageously, sifted and washed sand having a sand grain diameter of 1–3 mm is used for sanding, in accordance with the norms used on Swedish airfields. According to known thermodynamic principles, the greater the surface area/volume of the sand grains, or in other words the smaller their diameter, the easier it is to heat them. However, the sand grains should not be so small that they fail to function well as a coating on, for example, a runway, depending on the grip (the friction coefficient against tires) and blasting effect of the landing airplane. In practical tests, sand grains with a diameter of 1–3 mm have shown themselves to function well from all aspects.

The gas burners 8 work by the Bunsen principle and are configured to give a relatively long flame. They are supplied with liquified petroleum (LP) gas in the gas phase from a plurality of gas vessels 10 mounted in the vicinity of the gas burners 8. The burner capacity amounts to several hundred kilowatts.

For intermittent use of the burners 8, the gas phase of the LP gas can be taken directly from the gas vessels 10 through adiabatic vapourization without too large a decrease in pressure. For greater gas output, forced vapourization should be employed, for example via an LP gas vapourizer using the motor coolant water of the spreading vehicle as an energy supply, or with a temperature-limited LP gas burner warming the LP gas vessels, controlled by a regulator.

A reducing valve 9 acts to keep a constant pressure to the burners 8. The reducing valve 9 is adjustable to provide infinitely variable regulation of the capacity of the burners 8. In this way, the heating operation can be suited to different conditions. A magnetic valve, also encompassed by black box 9, controls the gas flow to all of the burners 8.

The heating operation, inter alia gas initiation and lighting the burners 8, can be remotely controlled via an electronic control system 9,11 from a control panel 11 in the driver cabin 13 which also includes status indicators for the heating system e.g. that the gas supply and burners are operating normally.

Within the context of the control system 9,11, the heating system 8,9,10,11 is provided with a number of protective functions for protection in the event that a fault should arise and to prevent imperfect end-results:

if any of the burners 8 go out, its flame is reignited automatically;

if reignition is not successful, the gas supply is turned off;

if the conveyor belt 5 stops, the gas supply is turned off;

if the gas supply to the burners 8 is insufficient, the gas supply is turned off.

As mentioned earlier, implementation of the presently described technique does not necessitate the acquisition of new sand spreading vehicles. The heating system can be installed on existing sand spreading vehicles of standard configuration without extensive modification. The heating system can also be easily demounted from the sand spreading vehicle, if required. Installation of the heating system on a sand spreading vehicle does require some modifications including the provision of an opening in the sand shaft 6 for the burners 8, supports for the burners, supports for the other components of the heating system, a power supply and a number of mechanical shields inter alia to protect the sand feed 5, sand shaft 6 and scattering plate 7 from excess temperature. Appropriate measures are readily apparent to those skilled in the art and need not be described further here.

Two years of full scale field trials at the Karlstad airfield have demonstrated that the presently described method for sand heating functions outstandingly well. The LP gas consumption has also been very low.

Additionally and surprisingly, the above described method has shown itself to also function very well for the spreading of urea, whose effectiveness is considerably enhanced in this fashion. The reaction time for urea to "melt" away ice to a large extent becomes almost immediate whereas in comparison it takes around 15 minutes when non-preheated urea is spread. The method should also be well suited to the spreading of preheated road salt, i.e. the method is not only applicable to airplane runways but also, for example, to vehicle roads.

While one embodiment has been chosen to illustrate the invention, it will be understood by those skilled in the art that various changes and modifications can be made therein without departing from the scope of the invention as defined in the appended claims.

The invention claimed is:

1. A process for scattering granular material at a raised temperature from a vehicle over a roadway, comprising the steps of:

feeding granular material from a supply container in a vehicle by a feed means to an upper, upstream portion of a substantially vertically disposed shaft;

conveying the granular material downwardly through the shaft to a scattering means at a lower, downstream portion of the shaft; and heating the granular material during passage thereof downwardly through the shaft by combustion gases flowing under pressure through the shaft from the upstream portion of the shaft to separate and uniformly heat individual particles of the granular material;

whereby, the combustion gases assist gravity in transporting the particles through the shaft.

2. A process according to claim 1 wherein the combustion gases flow completely through the shaft to the scattering means for further heating of the granular material.

3. A process according to claim 2 wherein the combustion gases flow through an outlet of the scattering means with the granular material.

4. A process according to claim 1 wherein the shaft is free of movable mechanical conveying means such that the granular material is conveyed through the shaft solely by gravity and the combustion gases.

5. A process according to claim 1 wherein the combustion gases directly contact the granular material in the shaft.

6. An apparatus for scattering granular material at a raised temperature from a vehicle over a roadway, comprising:

a supply container for holding granular material;

a substantially vertical shaft having an upper, upstream portion, a lower, downstream portion and a central axis;

feed means, extending between said supply container and said shaft, for conveying granular material from said supply container to said upstream portion of said shaft;

scattering means, located adjacent said downstream portion of said shaft, for dispersing the granular material; and heating means for heating the granular material in said shaft, said heating means including a burner having a nozzle means disposed above and directed towards said upstream portion of said shaft, said nozzle means being oriented substantially coaxially with said central axis of said shaft for flowing combustion gases under pressure through said shaft.

7. An apparatus according to claim 6 wherein said heating means comprises plural nozzle means; and plural vertical shafts extend above said scattering means.

8. An apparatus according to claim 6 wherein said feed means comprises a conveyor.

9. An apparatus according to claim 6 wherein said scattering means comprises a horizontally oriented rotating plate.

10. An apparatus according to claim 6 wherein said heating means comprises a gas vessel, an adjustable reducing valve and a magnetic valve coupled to said burner for regulating supply of combustible gas to said burner.

11. An apparatus according to claim 10 wherein said heating means comprises remote control means for switching supply of combustible gas on and off and for automatically switching off supply of combustible gas when feeding of granular material ceases.

12. An apparatus according to claim 6 wherein said heating means comprises remote control means for automatically igniting said burner, for monitoring flames exiting said nozzle means, for monitoring fuel supply to said burner, and for automatically ceasing fuel supply to said burner during malfunction.

13. An apparatus according to claim 6 wherein said heating means causes combustion gases thereof to directly contact the granular material in said shaft.

* * * * *